US005715698A

United States Patent [19]

Calton

[11] Patent Number: 5,715,698

[45] Date of Patent: Feb. 10, 1998

[54] EVAPORATIVE AIR COOLER

[76] Inventor: William R. Calton, 20697 Scofield Dr., Cupertino, Calif. 95014

[21] Appl. No.: 667,656

[22] Filed: Jun. 21, 1996

[51] Int. Cl.[6] ..... F25D 17/04; F28D 5/00

[52] U.S. Cl. ..... 62/309; 62/314; 62/316

[58] Field of Search ..... 62/304, 309, 314, 62/121, 316

[56] References Cited

U.S. PATENT DOCUMENTS

| | | | |
|---|---|---|---|
| 3,043,573 | 7/1962 | Chandler | 62/314 |
| 3,362,186 | 1/1968 | Patterson | 62/314 |
| 3,705,479 | 12/1972 | McPherson | 55/223 |
| 4,649,000 | 3/1987 | Biesemeyer | 261/92 |
| 4,798,060 | 1/1989 | Long et al. | 62/304 |
| 4,953,831 | 9/1990 | Albrecht | 261/102 |
| 5,168,722 | 12/1992 | Brock | 62/304 |

*Primary Examiner*—William Doerrler
*Attorney, Agent, or Firm*—Michael J. Hughes; Mark E. Baze

[57] ABSTRACT

An evaporative air cooler (10) employs a design in which admitted air flows over and along the surface of a wicking material (14) rather than through the wicking material (14) and, in the process, achieves a greater relative cooling ability thereby. The evaporative air cooler (10) has the primary components of a cooling chamber (12), the wicking material (14), a fan assembly (16), and, in the preferred embodiment, a feedback duct (18). The cooling chamber (12) includes a container portion (20) having an air outlet (40) in one end wall (36) thereof, and a cover portion (22) having an air inlet (44). The wicking material (14), which is towel-like in form, is draped upon the interior surfaces (56, 60, 62) of the container portion (20), with an opening (64) in the wicking material (14) cut so as to correspond to the location of the air outlet (40) and to allow an unimpeded passage of air therethrough. The lower portion of the wicking material (14) is immersed in water (66) reservoired in the bottom (32) of the container portion (20). Operation of the fan assembly (16) causes ambient air (68) to be drawn through the air inlet (44) and into the cooling chamber interior (28), the air (68) being cooled by equilibrating evaporative processes at the surfaces of the wicking material (14). The cooled air (72) is expelled by the fan assembly (16) through the air outlet (40) whereupon a small percentage of the cooled air (72) is recycled back to the air inlet (44) by the feedback duct (18) to further enhance the cooling ability of the evaporative air cooler (10).

19 Claims, 3 Drawing Sheets

EVAPORATIVE AIR COOLER

TECHNICAL FIELD

The present invention relates generally to evaporative air cooling devices and more particularly to an inexpensive, portable evaporative air cooler for cooling rooms.

BACKGROUND ART

The principles and technique of evaporative air cooling have been employed for a great number of years by peoples of many countries to obtain relief from uncomfortably warm environments. In India, for example, it is still common to cool living quarters by the simple technique of splashing water upon a loosely woven straw mat which is hung in a doorway. A supplemental cooling effect is obtained from the evaporation of the water as breezes blew through the mat. The necessity of having to continually replenish the water upon the mat is an annoyance, to say the least. A very similar technique was also common many years ago in the United States, especially in the Western states, in which a wet cloth sheet would be hung in from of a window to obtain the desired cooling effect. A continuous cooling ability could be had by having the lower part of the sheet stand immersed in water (contained in a trough), whereby the water necessary for the evaporative cooling was continuously fed to the sheet.

When electric fans were invented, devices variously known as "wet boxes," "drip coolers," and "swamp coolers" became common. These cooling devices were basically in the form of a box, with one or more sides of the box including a wicking material (e.g., cloth, excelsior, etc.) which either drew water from a reservoir (generally a pan at the bottom of the box) directly, or in which the water was dripped or sprinkled onto the wicking material from an overhead drip or sprinkling system. A fan, also located within the box, caused ambient air to be forcibly drawn through the wet wicking material, whereupon the air would be cooled by the evaporation of the water. The cooled air exited the box through an open, grill-covered side of the box to which the fan was oriented in order to blow the cooled air into a room.

Evaporative air coolers generally lost favor as refigerative processes became more affordable. However, they are still commonly employed and offer an inexpensive alternative to modem air conditioners in many situations that do not require cooling of an environment with air having a significant relative humidity. Disclosed in U.S. Pat. No. 5,168,722, issued to Brock on 8 Dec. 1992, is a portable evaporative air cooler for use in cooling off-road vehicles. Brock provides for a box-like water containment reservoir which includes a cartridge of wicking material mounted transversely therein, the wicking material being immersed in water. A fan assembly is mounted externally on top of the containment reservoir as part of a cover having an air admission aperture at one end and an air output aperture at the other. The fan assembly draws air through the air admission aperture and into the containment reservoir where it is forced to be drawn through the wetted wicking material and causing an evaporative cooling of the air thereby. The cooled air is then expelled out of the containment reservoir and through the air output aperture and associated fan assembly.

Like all other evaporative air coolers as are believed to have gone before, the invention of Brock performs the evaporative cooling process by forcibly drawing the air to be cooled through a wetted wicking material. A problem with this technique is that the wicking material is also made to act as a filter, such that it requires cleaning on a regular basis to free it from accumulated dirt and other air-flow restricting materials. Moreover, and especially important to allergy sufferers, is that such a flow-through method tends to promote a build up of mold and mildew within the wicking material. If the wicking material is not then cleaned regularly, or if the reservoir of water is not chemically treated, spores of mold and mildew are either distributed into the air or, at the very least, odors of varying degrees of unpleasantness are caused to occur. Brock describes a number of other prior art coolers, all of which incorporate the use of a flow-through evaporative media.

Because of the limitations associated with presently available evaporative air coolers, a substantial need still exists for an evaporative air cooler that is capable of providing an efficient evaporative cooling process but which is not dependent on a flow-through wicking material. Moreover, a great need exists for an evaporative air cooler that is less dependent upon the relative humidity of the environmental air for a suitable cooling performance.

DISCLOSURE OF THE INVENTION

Accordingly, it is an object of the present invention to provide an evaporative air cooler that produces evaporative cooling by circulating air about and along the surface of a wetted wicking material rather than through the wicking material.

It is another object of the invention to provide an evaporative air cooler that provides for a particular air flow and patterns of air and water eddies within a cooling chamber that are promotive of a highly efficient evaporative cooling equilibrium upon a wetted evaporative media.

It is a further object to provide an evaporative air cooler that is inexpensive to build and operate and which has a minimal complexity of construction.

It is yet another object to provide an evaporative air cooler that is easily transportable when that capability is desired.

It is yet a further object to provide an evaporative air cooler that may be used to produce cold, near freezing water for refrigerative functions.

It is still another object to provide an evaporative air cooler suitable for a wide range of applications.

Briefly, the preferred embodiment of the present invention is an evaporative air cooler that employs a design which circumvents the need for a flow-through, evaporative wicking material. The preferred embodiment is directed toward portable usage but the techniques as are embodied therein are generally applicable to any cooling application where a comparatively low relative humidity exists. The evaporative air cooler has the primary components of a cooling chamber, a wicking material, a fan assembly, and a feedback duct.

The cooling chamber is generally rectangularly box-shaped in form and includes a container portion, which serves as a water containment reservoir, and a cover portion. The container portion includes an air outlet which is located upon an end wall. Within the end wall is mounted the fan assembly. The wicking material, which is towel-like in form and preferably constructed of terry cloth or similar material, is draped upon (and pulled apart somewhat from) the interior surfaces of each of the side and end walls and bottom of the container portion, with an opening in the wicking material cut so as to correspond to the location of the air outlet and to allow an unimpeded passage of air therethrough. The lower portion of the wicking material is immersed in water. The cover portion includes an air inlet that is spacebly distanced from the air outlet and which is somewhat larger in area than the air outlet. In the preferred embodiment, the wicking material is simply held in position by being sandwichedly disposed between the cover portion and the container portion.

Operation of the fan assembly causes ambient air to be drawn through the air inlet and into the interior of the cooling chamber. Unlike all known prior art, the location of the air inlet and air outlet are such that no air is caused to be forcibly passed through the wicking material. Rather, the air passes over the wetted wicking material surfaces. As it does so, the air is cooled by equilibrative evaporative processes that are especially enhanced by the air flow and particular pattern of air and water eddies as are generated within the cooling chamber of the design presented by the present invention. An enhanced and/or collaborative cooling effect results from a slight vacuum that is also generated within the cooling chamber. The cooled air is expelled by the fan assembly through the air outlet whereupon a small percentage of the cooled air is recycled back to the air inlet by the feedback duct. A juxtaposed mounting of the feedback duct upon the cover portion causes a supplemental cooling of the cover portion. The cooling of the cover portion and/or the partial return of cooled air to the cooling chamber provides for a still further enhancement to the cooling ability of the evaporative air cooler.

An advantage of the present invention is that a greater cooling efficiency and ability is obtained relative to conventional air coolers.

Another advantage of the invention is that the preferred evaporative air cooler produces a constant output of air at approximately 22° C. (72° F.) regardless of relative humidity.

A further advantage is that the wicking material requires little or no cleaning.

Yet another advantage is that the growth of mold and mildew within the evaporative air cooler is prevented due to near freezing temperatures that occur at the primary evaporative surfaces.

Yet a further advantage is that the invention causes an extremely consistent amount of water to be introduced into the air per given time period thus allowing possible application as a vaporizer for introducing predetermined amounts of water soluble chemical substances into the air for medical inhalation or related purposes.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
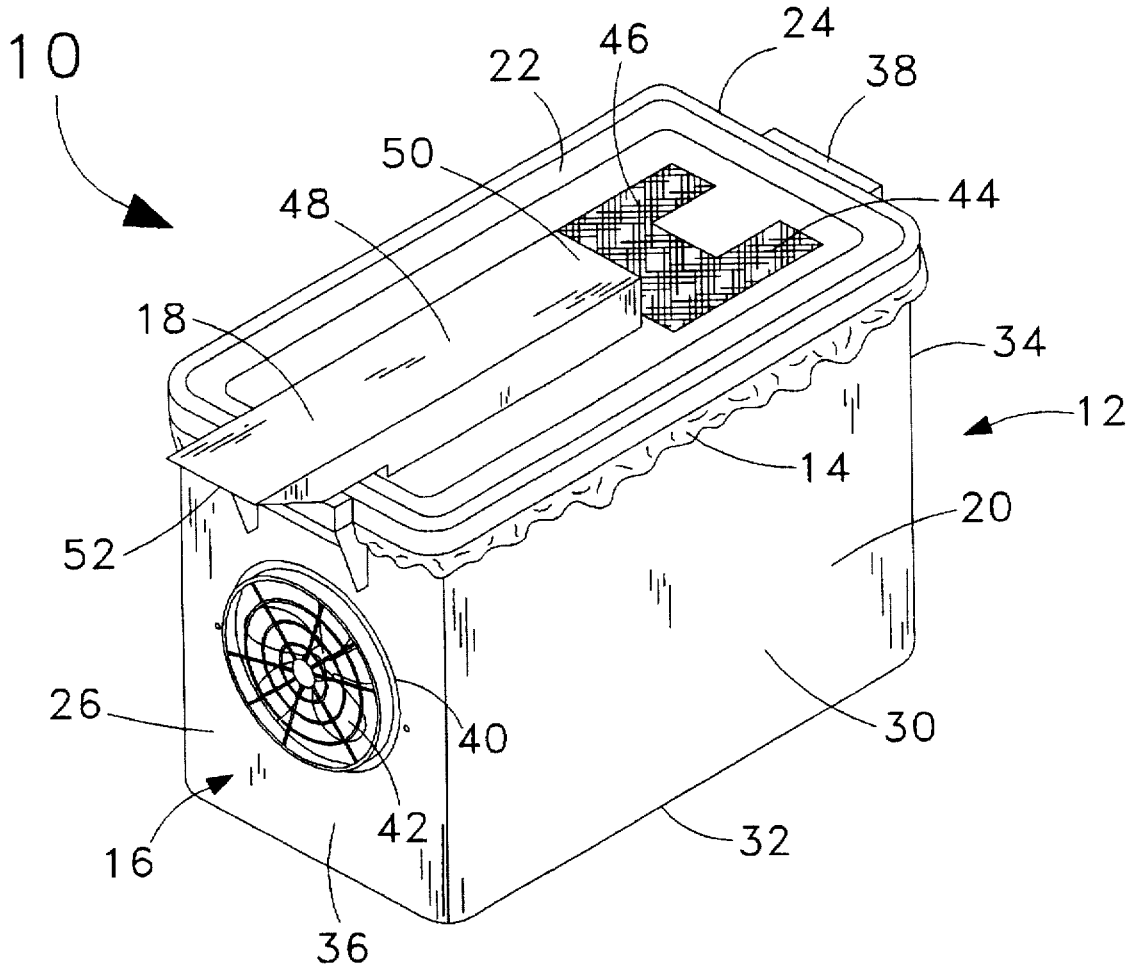
FIG. 1 is a perspective view of the preferred embodiment of the present invention.

The preferred embodiment of the present invention is an evaporative air cooler for portable cooling of rooms. The evaporative air cooler of the preferred embodiment is illustrated in a perspective view in FIG. 1, where it is designated therein by the general reference character 10.

Figure 2:
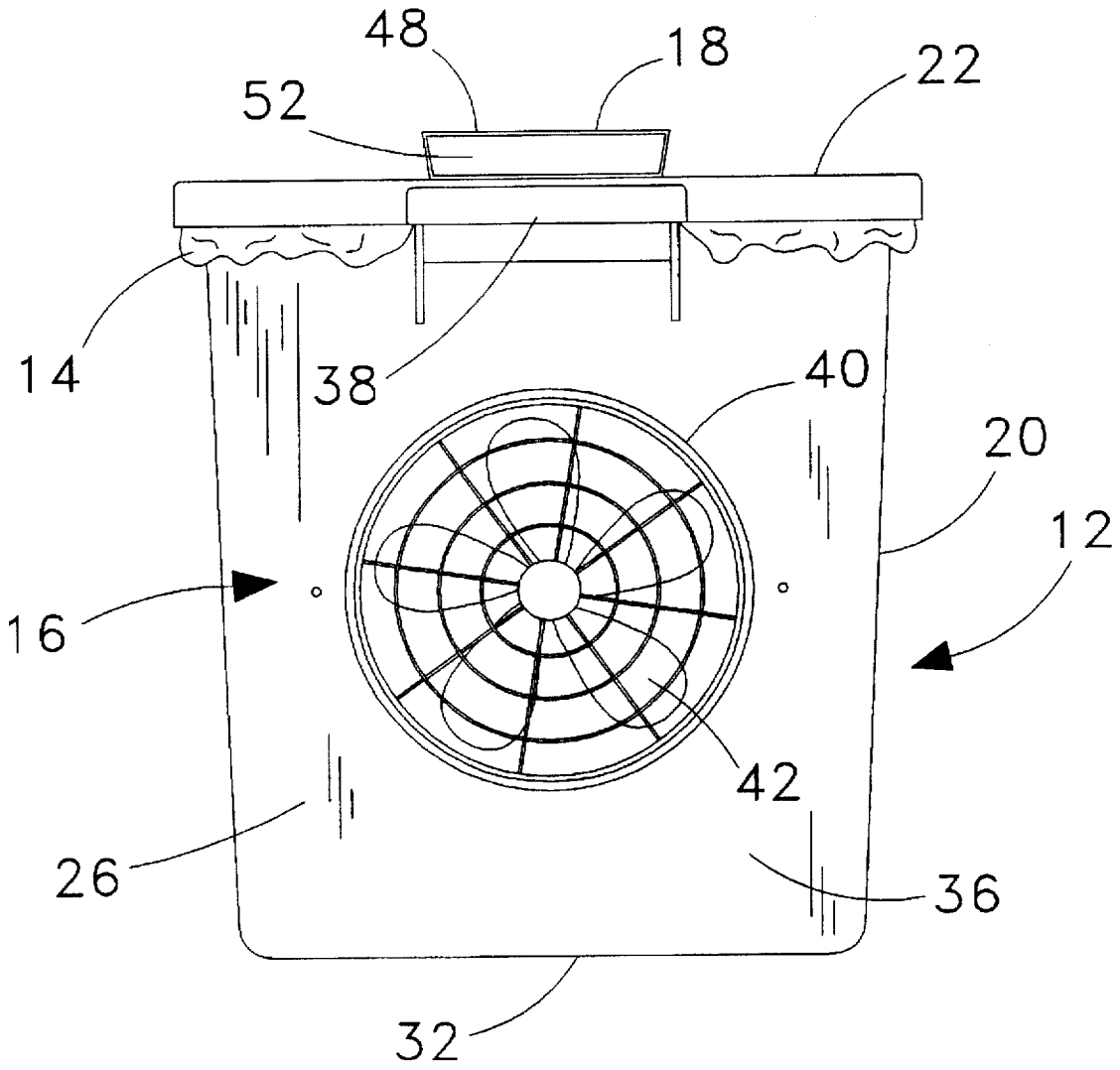
FIG. 2 is a view of the air output end of the embodiment show in FIG. 1.

Referring to FIGS. 1 and 2 of the drawings, the evaporative air cooler 10 is shown to be comprised of the major elements of a cooling chamber 12, a wicking material 14, a fan assembly 16, and a feedback duct 18. The preferred cooling chamber 12 is somewhat elongated and generally rectangularly box-shaped in form. The cooling chamber 12 includes a container portion 20 and a removable cover portion 22 which is mateably received by the container portion 20. The cover portion 22 fits upon the top of the container portion 20 sufficiently closely so as to prevent a significant flow of air at the interface therebetween, which might otherwise disrupt desirable air-flow and eddy patterns (described below) as are created within the cooling chamber 12. The cooling chamber 12 further includes what are denoted herein as an air intake end 24 and an air output end 26, both of which are in fluid flow communication with a chamber interior 28 (see FIG. 3). The preferred cooling chamber 12 is made of a plastic material, but it is to be understood that other materials or combinations of materials (such as plastic-lined wood) may also be employed provided that they exhibit a suitably corrosion-resistant and leak-proof nature with respect to a continuous contact with water as is necessarily inherent in the present invention.

Figure 3:
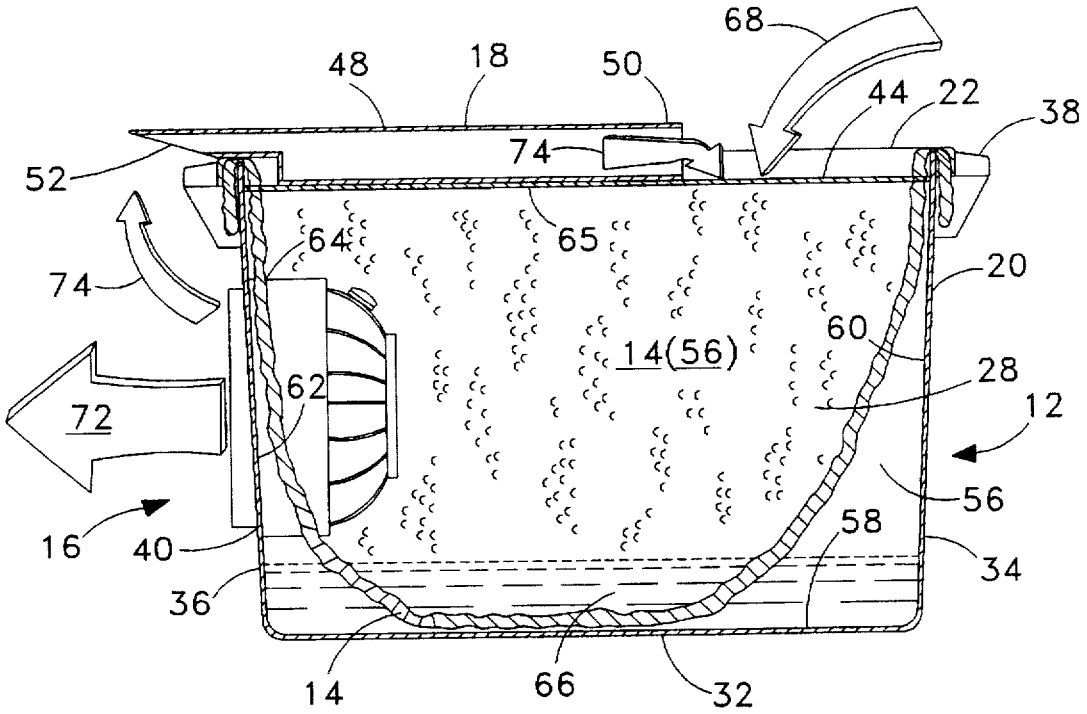
FIG. 3 is a side cross-sectional view of the embodiment shown in FIG. 1.

With continuing reference to FIG. 1, and now also referring to the side cross-sectional view of FIG. 3, the container portion 20 is comprised of a pair of side walls 30 which are integrally joined to a bottom 212 and first and second end walls 214 and 36. Each of the pair of side walls 30 and the first and second end walls (34 and 36) have a substantially vertical orientation (a slight taper from top to bottom is present in the preferred embodiment), with the first and second end walls (34 and 36) being located at the air intake and output ends (24 and 26) of the cooling chamber 12, respectively. Together, the pair of side walls 30, bottom 32, and first and second end walls (34 and 36) define a water containment reservoir. Handles 38 located near the top of each of the first and second end walls (32 and 214) enable convenient portable transport of the evaporative air cooler 10. The preferred container portion 20 has a length of approximately 46 to 51 cm (18 to 20 inches), a width of approximately 30.5 to 34 cm (12 to 13.5 inches), and a height of approximately 41 cm (16 inches). While the inventor has found that the length to width and height ratios as embodied in the foregoing appear to offer superior performance capabilities for the air cooler 10 as compared to other dimensions, it is to be understood that it is not intended that the present invention 10 be restricted to either those precise dimensions or to their proportional values. Further, it is to be understood that the cooling chamber 12 may be of a shape other than generally rectangular. Cubical, and even circular and elliptical box-like shapes are within the purview of the present invention, although the inventor has found that the greatest cooling effect appears to be achieved with the rectangular box shape.

As is perhaps shown best in the end view of FIG. 2, located within the second end wall 36 is an air outlet 40. The air outlet 40 of the preferred evaporative air cooler 10 is in the form of a circular opening centrally positioned approximately midway between the bottom 32 of the container portion 20 and the cover portion 22. It is within the air outlet 40 that the fan assembly 16 is insertably mounted and secured. In the preferred embodiment, the air outlet 40 is a single opening of approximately 20 cm (8 inches) in diameter, but it is to be understood that it is within the purview of the present invention 10 that multiple ones (and shapes) of such openings and/or fan assembly 1 employed where desired.

The fan assembly 16 itself is a commercially available 20 cm (8 inch) electric model having a variable speed ability and generating, in the preferred mode and air flow output speed of approximately 13–16 kph (8–10 mph). Fan blades 42 are made of a plastic material. That the fan blades 42 are made of plastic is important not only from a corrosion susceptibility standpoint, because of the humidified air that passes therethrough, but, moreover, the inventor has found that metal fan blades reduce the efficiency of the evaporation process within the cooling chamber 12 due (apparently) to an interfering static electricity generated at the surface of such fan blades. This static electricity causes relatively large water droplets to be emitted from the air outlet 40, as opposed to a more desirable "mist," when the evaporative air cooler 10 is operated.

Although in the several figures of the drawings the fan assembly 16 is shown as being mounted substantially within the chamber interior 28, the fan assembly 16 may also be mounted substantially or entirely externally of the cooling chamber 12 to accomplish a generally similar flow of air through the cooling chamber 12. The internal mounting has the benefit of giving the evaporative air cooler 10 a sleeker external appearance and also cools the motor portion of the fan assembly 16, thus giving a longer life expectancy thereto.

Referring again to FIG. 1, located at the air intake end 24 of the cooling chamber 12 and within the cover portion 22 is an air inlet 44. The air inlet 44 of the preferred evaporative air cooler 10 has a generally square, blocked "U" shape, wherein the base of the "U" is oriented toward the air output end 26. The inventor has found that this particular shape and arrangement for the air inlet 44 enhances the cooling ability of the evaporative air cooler 10 by assisting in the creation of an especially beneficial flow of air within the cooling chamber 12 (discussed in more detail below), perhaps due to the purposeful directing of the entering air against the wicking material 14. Again, however, performance that is substantially similar may be obtained with other air inlet 44 configurations (e.g., square, rectangular, circular, oval, and multiple, etc.). The shape of the air inlet 44 is not as important as the total area of the air inlet and the presence of a screen 44 (both of which are discussed below). It is also contemplated that an air inlet 44 of a variable air-admitting nature may be provided for in which a hinged "flap," sliding or rotating "window," or other arrangement is employed above and/or below and/or to the sides of the air inlet 44 in order to restrict or otherwise modify or alter the flow of air as it passes through the air inlet 44. In this manner, different air pressures, air flow, and air and water eddy patterns may be obtained within the cooling chamber 12 depending on the surrounding air temperature and wet bulb depression, and on the degree of cooling desired.

The air inlet 44 is covered by a screen 46 which is made of a fiberglass mesh material and which, as the designated name implies, acts to screen out foreign objects and large particulate matter. Moreover, the screen breaks up the air flow and improves the efficiency of the cooling process within the evaporative air cooler 10. The air inlet 44 and screen 46 provide for an opening within the cover portion 22 having, within the presently preferred embodiment, a total air admittance area of approximately 163 sq. cm (64 sq. inches).

As shown in FIG. 3, by action of the fan assembly 16, air is drawn into the air inlet 44 and through the length of the cooling chamber 12 whereupon it is forcibly exited through the fan assembly 16 and air outlet 42. A slight vacuum is created within the cooling chamber 12 when the evaporative air cooler 10 is in operation, which substantially increases the rate at which the driving evaporative and heat-exchange processes occur and correspondingly increases the cooling ability of the evaporative air cooler 10.

While the air inlet 44 and air outlet 40 are shown as being spaced apart in the drawings, it would be apparent to one of ordinary skill in the art that other configurations are possible in which, for example, a conduit (not shown) of some form might be provided within the chamber interior 28 to carry air from an alternative air inlet which would be located in much closer proximity to the air outlet 40 than is presently shown to a location farther removed and in the direction of the first end wall 34, so that again the air passes over a sufficiently large area of the wetted wicking material 14 to achieve the desired evaporative cooling effect. Such an alternative embodiment may include an air distribution manifold (not shown) within the cooling chamber 12 for purposes of optimizing the air flow and pattern of air and water eddies. (Although, it is the inventor's observation that the pattern of air flow and water eddies in the preferred embodiment appear to be random and turbulent—which may contribute to cooling process.) Further, it apparent that the air inlet 44 need not be limited to an aperture that is substantially flush with the cover portion 22 as shown but rather the air inlet 44 could include or be in the form of a flow-enhancing superstructure aperture (not shown) mounted upon or integral with the cover portion 22.

Referring in most part to the view of FIG. 3 now, mounted atop the cover portion 22 is the feedback duct 18. The feedback duct 18 is of a generally rectangular, continuous tubular shape and includes an arm portion 48. The arm portion 48 is horizontally disposed upon the cover portion 22 and runs from an air exit end 50, which is located in close proximity to the air inlet 44, to beyond the extreme air output end 26 of the cooling chamber 12. An air intake mouth 52 is provided to enable the feedback duct 18 to capture approximately 10% of the cooled air which exits from the air outlet 42. The captured air is returned via the arm portion 48 back along the upper surface of the cover portion 22 where the air exits the feedback duct 18 at the air exit end 50. The exited air is then dram within the air inlet 44 for recycling within the cooling chamber 12. In the preferred embodiment, the feedback duct 18 is 7.6 cm (3 inches) by 2.5 cm (1 inch) in cross section and is fabricated of a plastic or other material that is resistant to the corrosive effects of continuous exposure to moisture-laden air.

The feedback duct 18 causes the cooling chamber 12 to produce a more consistently cold output of air and further enhances the overall performance of the evaporative air cooler 10. Some of the enhancement obtained may be due to the cooling effect that the feedback duct 18 has upon the cover portion 22, with which the feedback duct 18 is in substantially coextensive contact. The cover portion 22, as will be seen below, is the only part of the chamber interior 28 which is not covered by the wicking material 14 and would therefore remain warmer than other surfaces within the chamber interior 28 were the cover portion 22 not supplementally cooled. Such a lack of cooling upon any one of the surfaces of the chamber interior 28, or upon any portion thereof, has been found by the inventor to cause a decrease in the cooling ability of the evaporative air cooler 10, apparently became of a less favorable flow of air and pattern of air and water eddies within the cooling chamber 12. It is apparent that a variety of feedback techniques might be employed to cool the cover portion 22 (an additional method is discussed below).

Continuing to refer to FIG. 3, and as already indicated above, the chamber interior 28 is fully lined with the wicking material 14 which is draped upon each of internal surfaces 56, 58, and 60 and 62 of the pair of side walls 30, the bottom 32, and the first and second end walls (34 and 36), respectively (internal surface 56 is hidden beneath the wicking material 14 in the Figure). As shown in the drawing figure, the inventor has found that some improvement in efficiency may be had where the wicking material 14 is actually pulled or stretched somewhat away from the internal surfaces 56, 60 and 62 so that the wicking material 14 slopes upward from the bottom internal surface 58 to the cover portion 22 and such that a significant air space is created between the wicking material 14 and one or more of the internal surfaces 56, 60 and 60. Presumably this permits a better contact of the entering air (see below) with the surfaces of the wicking material 14. On the other hand, a measurable decrease in the cooling ability and performance of the evaporative air cooler 10 has been noticed by the inventor where even a one-half inch square area of the internal surfaces 56, 58, and 60 and 62 is not covered or obscured with the wicking material 14.

The wicking material 14 that is draped upon the internal surface 62 of the second end wall 36 is provided with a circular opening or wicking material aperture 64. The wicking material aperture 64 is closely cut to coincide with the air outlet 40 such that no air actually flows directly through the wicking material 14 and yet provide that all of the internal surface 62 is covered with the wicking material 14. The wicking material aperture 64 also assists in the proper positioning of the wicking material 14 within the chamber interior 28 upon initial installation thereof (or after washing or replacement of the wicking material 14, should that be required).

In the presently preferred embodiment, the wicking material 14 is positioned and is held in place by simply being sandwichedly disposed between the cover portion 22 and the top of the container portion 20. The preferred wicking material 14 is formed from a single piece of absorbent toweling material (terry cloth) of approximately 0.91 sq. m (1.0 sq. yard) in area. The foregoing dimension provides that the ratio of wicking material 14 area to output area (i.e., the area of air outlet 40) for the evaporative air cooler 10 is approximately 125 to 1.

While in the drawings only internal surfaces 56, 58, and 60 and 62 of the cooling chamber 12 are covered with the wicking material 14, it is apparent that the underside 65 of the cover portion 22 might also be covered with the wicking material 14 as well, either in continuous fashion with the wicking material 14 as covers the pair of side wall internal surfaces 56 and/or with the wicking material 14 as covers the first and second end wall internal surfaces (60 and 62), or as a separately fashioned piece of wicking material which is wetted via a pump and drip system or similar arrangement (not shown).

The container portion 20 of the cooling chamber 12 is filled with water 66 to a depth of approximately 7.6 to 10 cm (3 to 4 inches), or approximately 11 liters (3 gallons), the water 66 covering the portion of the wicking material 14 present upon the bottom internal surface 58 of the container portion 20. When the fan assembly 16 is turned on and a flow of air through the cooling chamber 12 is created, water 66 is caused to be very rapidly absorbed by the wicking material 14 present upon the side and end wall internal surfaces (56 and 60 and 62) and dispersed there throughout (water 66 reaches the highest portions of the wicking material 14 in only two to three seconds after startup of the fan assembly 16). Thus, during operation, water 66 contained at the bottom of the container portion 20 is continuously absorbed and dispersed throughout the wicking material 14.

In operation, and as is graphically illustrated by the flow arrows of FIG. 3, ambient air 68 is drawn through the air inlet 44 and into the cooling chamber 12 by the reduced pressure created by the fan assembly 16 therein. The random and turbulent flow of the admitted air through the chamber interior 28 then causes, in conjunction with the air pressure differential that is also created within the cooling chamber 12, evaporation of water 66 present upon the wicking material 14. Some limited evaporation of the water 66 contained at the bottom 32 of the cooling chamber 12 also occurs. As the water 66 evaporates, cooling (and humidification) of air admitted within the cooling chamber 12 occurs. Cooled air 72 is then discharged through the fan assembly 16 and air outlet 40. As previously noted, some ten percent of the cooled air 72 is captured by the air intake mouth 52. This captured air 74 is returned via the feedback duct 18 for purposes of cooling of the cover portion 22 and for recycling through the cooling chamber 12.

In the preferred embodiment as described, the evaporative air cooler 10 consistently produces cooled air 72 having a temperature of approximately 22° C. (72° F.) at sea level (a slightly lower temperature is obtained at higher altitudes). Unlike all other evaporative air coolers as have been known heretofore, this 22° C. (72° F.) output is obtained regardless of the relative humidity of the ambient air 68. Thus, the invention is suitable for areas having a high humidity and for which evaporative coolers have previously been ineffective. Further, the evaporative air cooler 10 consistently dissipates about 0.2 liters (1 cup) of water into the air per hour, and this also appears to be irrespective of relative humidity. Thus it is expected that the evaporative air cooler 10 will find use in applications in which measured quantifies of inhalants are needed, or for other chemical air-interjectory processes.

Water 66 within the cooling chamber 12 cools to 33° F. (0.6° C.) during operation of the evaporative air cooler 10. It is contemplated by the inventor that the near-freezing water might be employed for refrigerative processes, e.g., direct cooling of beverage containers placed within the chilled water 66 contained in the container portion 20, or indirect cooling using fluid filled pipes and/or coils (or other forms of heat exchangers) that pass through the chilled water 66. That the water 66 becomes so cold is of great additional benefit in that mold or other organisms appear not to be capable of existing within the wicking material 14, thus cleaning of the wicking material 14 is only extremely infrequently required and there is never any odor associated with the operation of the evaporative air cooler 10.

Unlike all prior art evaporative air coolers as are believed to be known, no air is actually caused to pass forcibly through any of the wetted wicking material 14 (at least not by design). Rather, the configuration of elements as are comprised by the evaporative air cooler 10 appears to produce an especially desirable random and turbulent flow of air and patterns of air and water eddies within the chamber interior 28. The air flow and patterns of eddies appear to create an evaporation process at the surfaces of the wicking material 14 that is more efficient than is obtainable by conventional simple passage of air through a wet wicking material 14. When operating at peak output performance, the evaporative air cooler 10 of the preferred embodiment produces a mild "roaring" sound similar to that heard when a stream tumbles over rocks. That sound is believed to be the result of a harmonically turbulent air-water boundary layer which is produced at the surface of the wicking material 14 and which is conducive to an especially facile equilibrium transfer of water into the vapor phase and therefore to an enhanced evaporative and cooling process. Alternatively, the inventor believes it is possible that the especially efficient cooling provided by the evaporative air cooler 10 may be due to an increased molecular collision process at the air/wick boundary layer which may explain the achievement of near freezing temperatures within the cooling chamber 12 and a slight positive voltage that is detectable between the water 66 and ground source (current seepage or discharge from the fan assembly 16 has not yet been ruled out with respect to the latter result).

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The preferred evaporative air cooler 10 of the present invention is designed to be used for the convenient cooling of any room or similarly enclosed space, such as a bedroom or garage. The cooling ability of the evaporative air cooler 10 is not limited by the moisture content of the ambient air to be cooled, and a good cooling may be achieved even in regions having high levels of relative humidity. That the evaporative air cooler 10 uses very little water makes its use possible even in parts of the country where water resources are problematic.

Use of the evaporative air cooler 10 is simple. The wicking material 14 is placed within the container portion 20 and evenly distributed upon the interior surfaces 56, 58, and 60 and 62 therein, with the wicking material aperture 64 in alignment over the fan assembly 16 and air outlet 40. Water 66 is added to the container portion to a depth of several inches (several centimeters) so that the lowermost portion of the wicking material is completely immersed. An excess portion of the wicking material 66 is caused to be caught between the cover portion 22 and the container portion 20 upon placement of the cover portion 22 upon the container portion 20 in order to positionably hold the wicking material 14. The fan assembly 16 is then turned on whereupon water 66 is very rapidly absorbed and wicked to the top of the wicking material 14, and the evaporative cooling process commences very shortly thereafter.

In addition to a complete lack of mold and mildew buildup upon the wicking material 14, the inventor has also noticed an air cleaning ability by the evaporative air cooler 10, despite the presence of any filtering media. It is postulated that the very cold temperatures as are achieved within the cooling chamber 12, and the equilibrative processes as also occur within, cause a precipitation of various air-borne materials from the air and into the water 66. Thus, the evaporative air cooler 10 also acts to freshen the air. Indeed, the stream sound produced by the air cooler 10, together with its air-freshening ability, helps produce the sense of well-being felt experienced in the fresh outdoors.

For the foregoing reasons, and for numerous others as set forth previously herein, it is expected that the industrial applicability and commercial utility of the present invention will be extensive and long lasting.

What is claimed is:

1. An evaporative air cooler, comprising:

a cooling chamber, said cooling chamber including a container portion, a cover portion, and a chamber interior, the container portion having a bottom and a substantially vertically oriented interior surface, the chamber interior defined by the cover portion, the bottom and the interior surface, the cooling chamber having an air inlet and an air outlet;

fan means for drawing air through the air inlet and into the chamber interior, said fan means mountably associated with the air outlet and expelling the admitted air therethrough;

vacuum means for causing a partial pressure reduction within said cooling chamber, said vacuum means including said fan means;

wicking material having an evaporative surface, said wicking material substantially covering the interior surface; the air inlet, the air outlet and said wicking material bearing a relative disposition to one another such that the admitted air passes primarily over and along the evaporative surface rather than through the wicking material;

water means for supplying said wicking material with water, the water provided to said wicking material evaporated by both the flow of the admitted air and the partial pressure reduction and causing cooling of the admitted air thereby; and feedback means for recycling the cooled expelled air back into the cooling chamber to achieve an increased cooling effect thereby.

2. The evaporative air cooler of claim 1 wherein the coverage of said wicking material upon the interior surface includes the wicking material being displaced from such interior surface to create an air space between said wicking material and the interior surface.

3. The evaporative air cooler of claim 1 wherein the feedback means is a feedback duct, the feedback duct having an air intake mouth and an air exit end, the feedback duct mounted upon said cooling chamber and in close association with the cover portion, the air intake mouth positioned near the air outlet, the air exit end positioned near the air inlet.

4. The evaporative air cooler of claim 1 wherein said water means includes water reservoired within the chamber interior and said wicking material extending into the reservoired water to absorb the water.

5. The evaporative air cooler of claim 1 wherein said cooling chamber has a length, and the air inlet is spaceably distanced from the air outlet by substantially the length.

6. The evaporative air cooler of claim 1 wherein the air inlet is covered with a screen material.

7. The evaporative air cooler of claim 1 wherein the air inlet has a substantially horizontally disposed block "U" shape with the bottom of the "U" oriented in the direction of the air outlet.

8. The evaporative air cooler of claim 1 wherein said fan means includes a fan assembly mounted substantially in the chamber interior and within the air outlet.

9. An evaporative air cooler, comprising:

a container portion, said container portion having a water reservoir capability and including a pair of side walls, a first end wall, a second end wall, and a bottom, each of the pair of side walls and the first and second end walls having an interior surface associated therewith, the first end wall including an air outlet, the air outlet having an associated first aperture area;

a cover portion, said cover portion mateably fittable upon said container portion, said cover portion including an air inlet, the air inlet having an associated second aperture area;

fan means for drawing air through the air inlet and into said container portion, said fan means mountably associated with the air outlet and expelling the admitted air therethrough;

vacuum means for causing a partial pressure reduction within said cooling chamber, said vacuum means including said fan means and the first and second aperture areas, whereby the ratio between the first and second aperture areas in cooperation with said fan means effects the partial pressure reduction; and wicking material, said wicking material substantially covering each of the interior surfaces and extending into water reservoired within said container portion; the air inlet, the air outlet and said wicking material bearing a relative disposition to one another such that the admitted air passes substantially over and along said wicking material versus through said wicking material, the passage of the air and the partial pressure reduction effecting in combination an accelerated evaporation of the water from said wicking material.

10. The evaporative air cooler of claim 9 wherein the coverage of said wicking material upon at least one of the interior surfaces includes said wicking material being displaced from such interior surfaces to create an air space between said wicking material and such interior surfaces.

11. The evaporative air cooler of claim 9 further including a feedback duct, the feedback duct having an air intake mouth and an air exit end, the feedback duct mounted upon said cover portion, the air intake mouth positioned near the air outlet, the air exit end positioned near the air inlet, a portion of the expelled cooled air recycled back to the container portion thereby.

12. The evaporative air cooler of claim 9 wherein the air inlet is covered with a screen material.

13. The evaporative air cooler of claim 9 wherein said wicking material is fashioned of terry cloth toweling.

14. The evaporative air cooler of claim 9 wherein said wicking material is positionably held in place by sandwichable disposition between said container portion and said cover portion.

15. The evaporative air cooler of claim 9 wherein said fan means includes fan blades made of plastic.

16. An improved evaporative air cooler of the type in which a fan means is employed to draw air into and out of a cooling chamber having an air inlet and an air outlet, a water reservoir, and wicking material, the air inlet and air outlet having first and second aperture areas, respectively, wherein the improvement comprises:

substantially all interior surfaces of the cooling chamber being covered with the wicking material;

the air inlet, the air outlet, and the wicking material being disposed relative to one another such that admitted air flows over and along the wicking material rather than forcibly through the wicking material; and vacuum means for causing a partial pressure reduction within said cooling chamber, said vacuum means including said fan means and the first and second aperture areas, whereby the ratio between the first and second aperture areas in cooperation with said fan means effects the partial pressure reduction to further augment the evaporation of water from the wicking material thereby.

17. The improved evaporative air cooler of claim 16 wherein the cooling chamber includes a container portion, the container portion having substantially vertically oriented walls, the interior surfaces being interior surfaces of the walls.

18. The improved evaporative air cooler of claim 17 wherein the coverage of the wicking material upon the interior surfaces includes the wicking material being displaced from such interior surfaces to create at least one air space between the wicking material and the water.

19. The improved evaporative air cooler of claim 16 further including feedback means for recycling cooled expelled air back into the cooling chamber to achieve an increased cooling effect thereby.

* * * * *

UNITED STATES PATENT AND TRADEMARK OFFICE

CERTIFICATE OF CORRECTION

PATENT NO. : 5,715,698
DATED : February 10, 1998
INVENTOR(S) : CALTON, William R.

It is certified that error appears in the above-identified patent and that said Letters Patent is hereby corrected as shown below:

In the Abstract:

In the next-to-last sentence (line 21), replace "equilibrating" with --equilibrative--.

Column 1, line 43; replace "refigerative" with --refrigerative--.

Column 1, line 46; replace "modem" with --modern--.

Column 4, line 66; replace "assembly 1 employed" with --assemblies might be employed--.

Column 6, line 40; replace "dram" with --drawn--.

Column 6, line 61; replace "became" with --because--.

Signed and Sealed this

Fourteenth Day of April, 1998

Bruce Lehman

BRUCE LEHMAN

*Commissioner of Patents and Trademarks*

*Attest:*

*Attesting Officer*